United States Patent [19]

Griffiths

[11] 3,940,007

[45] Feb. 24, 1976

[54] CONTAINERS

[76] Inventor: Aubrey Ronald Griffiths, P.O. Box 4014, Hamilton, New Zealand

[22] Filed: Oct. 22, 1974

[21] Appl. No.: 517,109

[52] U.S. Cl. ..... 220/4 F; 217/12 R
[51] Int. Cl.[2] ..... B65D 7/00
[58] Field of Search ..... 220/4 R, 4 F; 217/12 R, 217/43 R, 65 R

[56] References Cited

UNITED STATES PATENTS

| | | | |
|---|---|---|---|
| 1,428,016 | 9/1922 | Eddy | 217/12 R |
| 2,547,672 | 4/1951 | Spanjer | 217/12 R |

*Primary Examiner*—William Price
*Assistant Examiner*—Steven M. Pollard
*Attorney, Agent, or Firm*—Wenderoth, Lind & Ponack

[57] ABSTRACT

Containers are made from container sections, placed one upon the other. Each section has four sides. Corner members are placed on each side edge of each side. The corner member on one side edge is L shaped and the corner member on the other side edge is J shaped. The L shaped and J shaped members co-act to allow adjacent sides to be removably fixed one to the other.

4 Claims, 4 Drawing Figures

CONTAINERS

BACKGROUND OF THE INVENTION

This invention relates to containers.

At present containers in which materials are transported have the disadvantage that when in an empty state during storage or transportation a large volume of space is needed for such storage or transportation.

SUMMARY OF THE INVENTION

It is therefore an object of the present invention to provide a container which will obviate or minimise the foregoing disadvantages in a simple yet effective manner or which will at least provide the public with a useful choice.

In one aspect the invention comprises a container including a base and a plurality of container sections, each container section comprising four vertical sides, one side edge of each side having a corner member at least including a substantially J shaped part extending therefrom and the side edge of an adjacent side having a corner member at least including a substantially L shaped part extending therefrom, the construction and arrangement being such that one side may be slid relative to the other side in a manner such that the toe of the substantially L shaped part becomes engaged between the toe and the stem of the substantially J shaped part to hold the two adjacent sides in engagement one with the other in a manner such that longitudinal movement of one side relative to the adjacent side is obviated or minimised.

The invention consists in the foregoing, and also envisages constructions of which the following gives examples only, and where specific integers are mentioned herein which have known equivalents in the art to which this invention relates, such known equivalents are deemed to be incorporated herein as if individually set forth.

BRIEF DESCRIPTION OF THE DRAWING

One preferred form of the invention will now be described with reference to the accompanying drawings in which.

DETAILED DESCRIPTION OF THE INVENTION

In the preferred form of the invention a container is provided as follows:

A container base 2 is provided and a plurality of container sections are also provided. Each container section comprises four vertical sides 3, each side 3 being jointed to two other sides 3 to prevent movement of two adjacent sides 3 relative to those joints out of the plane of those sides 3. Adjacent sides 4 and 5 as shown in FIG. 4, which correspond to sides 3 in FIGS. 1–3 and which may be any two adjacent sides in a container section, carry parts of corner members thereon which corner members are constructed so that each container section may be dismantled into its four sides and may also be re-assembled when desired.

Figure 4:
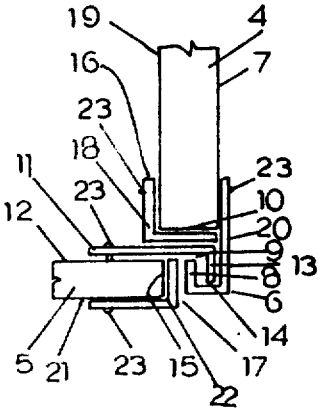
FIG. 4 is a planar view of a junction between two sides for use in a container according to the invention.

The corner members may comprise, for example, a member 6 which member 6 at least includes a part of substantially J shaped cross section, and the member 6 may be entirely of a J shaped cross section as shown in FIG. 4. The member 6 is affixed to the side 4, for example, to the outer face surface of the side 4 and so that the toe 8 of the substantially J shaped member 6 is inwardly facing. A gap 9 is left between the end of the toe 8 and the side edge 10 of the side 4.

A further member 11 is provided which at least includes, a part of substantially L shaped cross section and may be entirely an L shaped cross section as shown in FIG. 4 and which member 11 is affixed to the container side 5. The member 11 may be, for example, positioned on the inner surface 12 of the container side 5 and positioned so that the toe 13 of the L shaped member 11 when erected will pass into the slot 14 formed on one edge thereof by the toe 8 of the J shaped member 6.

In the embodiment shown in FIG. 4 the toe 13 of the L shaped member 11 is positioned substantially in a plane parallel to the plane containing the end face 15 of the side 5. Thus in the embodiment shown the substantially L shaped member 11 may be slid between the toe 8 and the stem of the J shaped member 6 to hold the adjacent container sides 4 and 5 together in a manner such that whilst vertical movement of one side relative to the other is allowed by the corner member, longitudinal movement of one side relative to the adjacent side is obviated or minimised.

A further two substantially L shaped members 16 and 17 may also be provided in the embodiment shown if desired. One of the further L shaped members may be provided having the stem 18 thereof adjacent the inner surface 19 of the side 4, and the toe 20 of L shaped member 16 may be positioned across the end face 10 of the side 4.

The other further L shaped member 17 may be positioned on the outer face 21 of the side 5 and positioned in a manner such that the toe 22 is across the end 15 of the side 5. The members 16 and 17 if provided give a substantially solid base to which fixing means such as bolts 23 or screws may be passed to affix the members 6, 11, 16 and 17 to the container sides 4 and 5. Also when the end members are constructed of a metal, satisfactory sliding surfaces are provided by the members.

Figure 1:
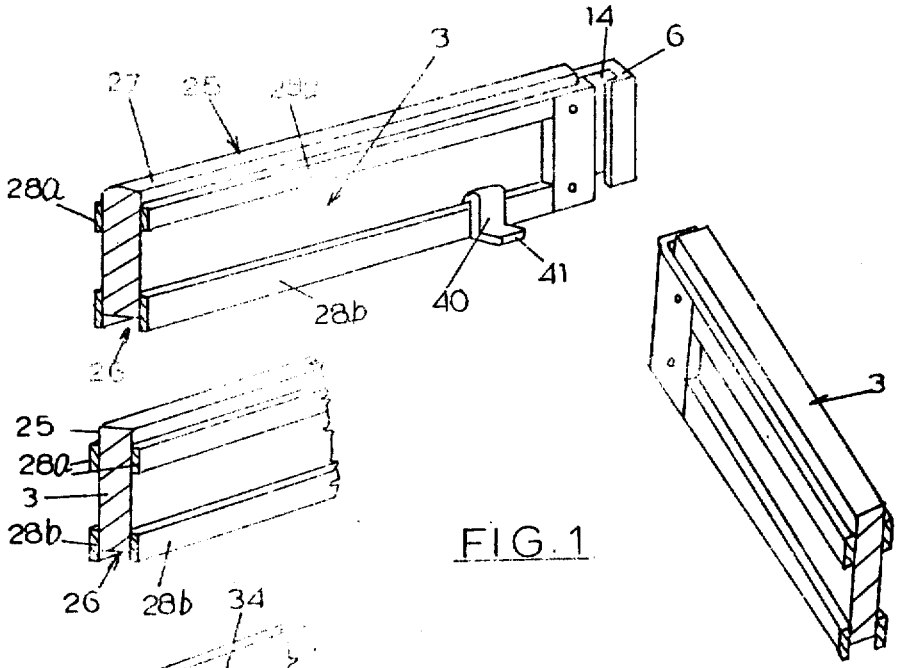
FIG. 1 is an exploded diagrammatic view of parts of a container according to the invention.

Engaging means are provided on the top 25 and bottom 26 edges of the containers section 3 so that each container section 3 may be engaged with the container section immediately above and the container section immmediately below each container section. The engagement means are, for example, a shaped edge around the perimeter of the container section and a complementary shaped edge around the perimeter of the container section with which the first container section is to be engaged. The shaped edge may be, for example, in the form of a tongue and groove arrangement constructed, for example, as shown in FIG. 1 by providing a portion 27 constructed of, for example, a fibre, plywood, fibreglass, plastic or other material and outer sections 28a and 28b affixed to the centre section 27 which outer sections 28a and 28b may comprise, for example, metal members such as steel members. The side members 28a and 28b also give additional strength to the central member 27. The corner members, 6, 11, 16 and 17 may be affixed to straps 28a and 28b by e.g. welding before the sides are assembled to enable relative ease of assembly.

Figure 2:
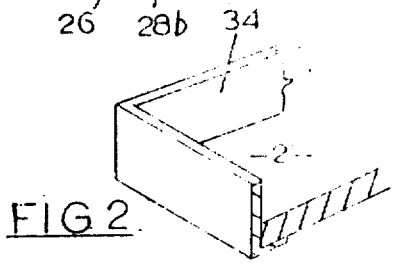
FIG. 2 is a cross sectional view of a part of two vertical sides in an alternative embodiment for use in a container according to the invention.

Alternatively the engagement means may be constructed as in FIG. 2 wherein a substantially H shaped member 30 is provided on one member 3, for example, the lower side and a further tongue member 31 is affixed to the side 3 which the other side 3 is to engage. The H member 30 and tongue member 31 may be constructed, for example, of an extruded metal material.

Figure 3:
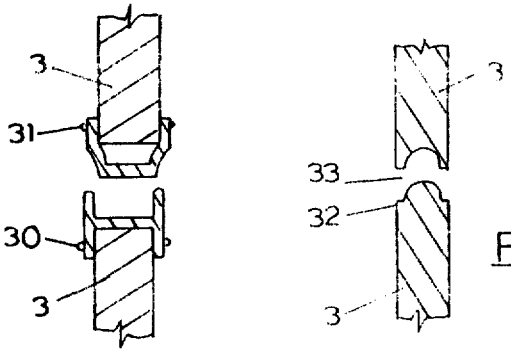
FIG. 3 is a further alternative of FIG. 2.

As a still further alternative the sides may be constructed, for example, in a semi-circular form such that semi-circular tongue 32 will engage in semi-circular groove 33 and of course it will be apparent that the tongue may be on the upper board and the groove on the lower board, as well as the arrangement shown in FIG. 3.

A container base 2 may be provided and this may include a rim 34 about or adjacent the perimeter thereof, which rim 34 may engage in the groove 26 on the lower container section. The rim 34 may be provided by means of an angle member about a base member e.g. an angle iron about a wooden member. Apertures may be provided in the base through which feet or pots may be inserted. The apertures may be in three rows of three to allow eight way entry thereto by e.g. a fork lift.

Furthermore a lid may be provided and this may also include, for example, a rim around or adjacent the perimeter thereof which is adapted to engage the topmost part of the container sections. The lid may also comprise a central, e.g. wooden, member with an angle member, e.g. an angle iron, thereabout.

It is also envisaged that dividing means may be provided to allow the space within the container to be divided into sections, and the dividing means may include clips 40 shaped to provide a bearing surface 41 to support a substantially planar member (not shown). The clips 40 may be inserted between the central member 27 and inner side member 28b.

The use of the invention in the preferred form is as follows.

The container base 2 is positioned as desired and the container may be built up thereon. Thus one container side 3 may be engaged with a rim 34 on the container base 2 and a further container side then engaged with the original container side by, for example, positioning the corner members one above the other such that the L shaped member 11 is positioned above or below the J shaped member 6. The two members are then moved one towards the other by, for example, moving one member, that is to say, the second member being positioned towards the first positioned member in a manner such that the L shaped toe of the member 11 passes into the slot 14 formed by the J shaped member 6.

Further container sides are then added as desired. Alternatively container section may be built up firstly by joining four sides in the form of a square and these may be added to the container base 2.

Alternatively a three sided container may be constructed, i.e. that is to say a container may be built up having one side blank. The container may then be filled with produce as desired, and the fourth side then added after which the lid may be added. Suitable straps are then passed around the container, the lid and the base, as desired to hold the container in the closed position. If desired clips 40 and the substantially planar member may be inserted to divide the container space into smaller spaces.

Thus it can be seen that a container is provided which is simple in construction and operation and which may be dismantled for storage or transportation in an empty state in a dismantled condition so that a relatively small volume of space is required for such storage or transportation.

I claim:

1. A container comprising:

a base;

a plurality of container sections each comprising four vertical sides;

each adjacent pair of sides including a first side having a corner member including at least a substantially J shaped part extending therefrom, and a second side having a corner member including at least a substantially L shaped part extending therefrom;

said first and second sides being relatively slidably movable with a toe of said L shaped part engaged between a toe and a stem of said J shaped part, with longitudinal movement of one of said sides relative to the other of said sides being prevented; and a first L shaped member having a stem fixed to an inner face of said first side and a toe adjacent an end face of said first side.

2. A container as claimed in claim 1, wherein said substantially J shaped part comprises a substantially J shaped member having said stem thereof positioned on an outer face of said first side and said toe thereof positioned in a plane closer to the plane containing said inner face than the plane containing said outer face surface of said first side.

3. A container as claimed in claim 1, wherein said substantially L shaped part comprises a substantially L shaped corner member having a stem mounted on an inner face of said second side, and said toe thereof positioned in a plane parallel to a plane containing an end face of said second side.

4. A container as claimed in claim 1, further comprising a second L shaped member having a stem adjacent an outer face of said second side and a toe adjacent an end face of said second side.

* * * * *